US006539585B1

(12) United States Patent
Anthony

(10) Patent No.: US 6,539,585 B1
(45) Date of Patent: Apr. 1, 2003

(54) DEVICE TO SEPARATE CONTAMINANTS FROM COTTON AND FLAX

(75) Inventor: William S. Anthony, Greenville, MS (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 0 days.

(21) Appl. No.: 09/962,568

(22) Filed: Sep. 25, 2001

(51) Int. Cl.[7] ..... D01B 1/04
(52) U.S. Cl. ..... 19/48 R; 19/39
(58) Field of Search ..... 19/5 R, 6, 24, 19/39, 40, 41, 42, 48 R, 54, 55 R, 57, 58, 59, 60, 61, 64.5, 105, 106 R, 200, 202, 203, 204, 205; 241/7, 13, 159, 73, 76, 77, 78, 79, 88.4; 209/22, 23, 30, 33, 31, 12.1

(56) References Cited

U.S. PATENT DOCUMENTS 5,392,495 A * 2/1995 Horn ..... 19/48 R
5,412,844 A * 5/1995 Horn et al. ..... 19/40
5,513,805 A * 5/1996 Fisher et al. ..... 241/73
5,909,786 A 6/1999 Anthony
5,970,582 A * 10/1999 Stover ..... 19/24
6,038,741 A * 3/2000 Winn ..... 19/39
6,079,647 A * 6/2000 Leduc et al. ..... 19/24

OTHER PUBLICATIONS

Anthony, W. S., "Overview of the Ginning Process", *Cotton Ginners Handbook*, USDA–ARS Agricultural Handbook No. 503, Dec. 1994, Section 5–The Ginning Process, pp. 43–46.

Baker, R.V., et al., "Seed Cotton Cleaning and Extracting", USDA–ARS Agricultural Handbook No. 503, Dec. 1994, Section 5–The Ginning Process, pp. 69–75.

Mangialardi, Jr., G.J., et al., "Lint Cleaning", USDA–ARS Agricultural Handbook No. 503, Dec. 1994, Section 5–The Ginning Process, pp. 102–119.

* cited by examiner

*Primary Examiner*—Gary L. Welch
(74) *Attorney, Agent, or Firm*—M. Howard Silverstein; Randall E. Deck; John D. Fado

(57) ABSTRACT

A process and apparatus for removing foreign matter from fibers, such as from cotton or flax with significantly reduced damage are disclosed. This cleaning is achieved without any of the condenser, compression rollers, or feed roller and feed plate which are present on conventional lint cleaners.

27 Claims, 10 Drawing Sheets

DEVICE TO SEPARATE CONTAMINANTS FROM COTTON AND FLAX

BACKGROUND OF THE INVENTION

1. Field of the Invention

The present invention relates to a method and apparatus for separating foreign matter from fibers. More particularly, the present invention provides a method and apparatus for separating entrained and/or adherent foreign matter, such as plant parts and other contaminants, from fibers such as cotton or flax.

2. Description of the Prior Art

Cotton possesses its highest fiber quality and best potential for spinning when it is on the stalk. Lint quality of the cotton, after it has been picked and baled, however, depends on many factors, including variety, weather conditions, cultural and harvesting practices, moisture and trash content, and ginning processes. The principal function of a cotton gin is to separate lint (fiber) from seed. But the cotton gin must also be equipped to remove a large percentage of foreign matter from the cotton that would significantly reduce the value of the ginned lint. For purposes of the following discussion, foreign matter is understood to include trash and debris such as leaf particles, motes, grass, and bark, displaced dry or wet lint, wet matter, green bolls, cotton seed, and underdeveloped cotton seed that are associated with the cotton ginning process.

A ginner generally has two objectives: (1) to produce lint of satisfactory quality for the growers' market; and (2) to gin the cotton with minimum reduction in fiber spinning quality so that the cotton would meet the demands of its ultimate users-the spinner and the consumer. Accordingly, quality preservation during ginning requires the proper selection and efficient operation of each machine that is included in a ginning system.

A thorough description of the cotton ginning process and the various components used is described by Anthony, W. S., et al. (Editors), *Cotton Ginner's Handbook*, Agricultural Handbook No. 503, USDA: Agricultural Research Service, December 1994, the contents of which is incorporated by reference herein. In brief, to begin the ginning process, cotton is transported from a trailer, module, or other storage means into a green-boll trap in the gin where green-bolls, rocks and other heavy foreign matter are removed to prevent damage to the machinery. Then, an automatic feed control provides an even, well-dispersed flow of cotton so that the gin's cleaning and drying system will operate more efficiently. The cotton is subsequently heated in a dryer and cleaned in a cylinder cleaner and stick machine. After drying and cleaning, the cotton is distributed to each gin stand by a conveyer.

The cotton enters the gin stand and the saws in the gin stand grasp the cotton and draw it through widely spaced ribs known as huller ribs. The locks of cotton are drawn through the huller ribs into the lower portion of the seed-roll box. The actual ginning process, i.e., separation of the seed and lint, takes place in the roll box of the gin stand.

From the gin stand, the cotton is conveyed into a lint cleaner for further removing foreign matter such as trash, plant parts, leaf particles, motes, grass, and bark that may remain in cotton after cleaning, extracting, and ginning. The most common lint cleaner in the ginning industry is the controlled-batt saw lint cleaner (SLC). In the SLC, lint from the gin stand is formed into a batt on a condenser screen drum. The batt is then fed through one or more sets of compression rollers and between a feed roller and feed plate to deliver a batt of uniform thickness onto a saw cylinder. The saw carries the fiber under grid bars. While the fibers are on the saw cylinder, they are cleaned of foreign matter by a combination of centrifugal force, scrubbing action between saw cylinder and grid bars, and gravity assisted by an air current. After the cotton has passed through the lint cleaner, the cleaned cotton is compressed into bales which must then be covered to protect them from contamination during transportation or storage.

Although the controlled-batt saw lint cleaner is the most effective cleaning machine in the gin, it is also the most damaging to the fibers. Significant damage to the fibers may occur as they are transferred from the condenser and rollers onto the saw cylinder, and as the fibers are cleaned while on the saw. The saw cylinder rotates at high speed in a direction which is opposite to the flow of cotton from the roller and feed plate. The abrupt change of speed and direction of the flow of the cotton batt as it is engaged by the saw cylinder creates a combing action, which aligns the fibers and gives them a smoother appearance. However, this also subjects the fibers to a high degree of stress, resulting in fiber breakage. Additional fiber damage as well as fiber loss occurs as the fibers are carried by the saw cylinder across the grid bars.

While numerous systems for cleaning cotton fibers have been developed, relatively few systems for the recovery and cleaning of flax fibers have been developed in the United States. Two general types of flax (Linum usitatissimum L.) are grown, flax for fiber and flax for seed. The fiber is extracted from the fiber flax stalks, and is typically used in manufacturing items such as linen apparel. The stalk consists of fiber bundles located between the epidermis or bark surface and an inner wood core (shive), and the processes for the separation of the fibers are difficult and expensive. Moreover, the processes normally used for separation of fiber from fiber flax typically require the stalk to be biologically degraded or retted before mechanical processing. In contrast to fiber flax, the seed flax stalk remaining after the seed has been harvested and recovered is usually considered a waste product. Although the flax in the seed flax stalk can be separated, the conventional processes used for separation of fiber from fiber flax, are not feasible for seed flax stalks.

Thus, despite the improvements in ginning technology, the need persists for an improved ginning system which will effectively clean cotton while reducing fiber damage and loss. Moreover, there is also a need for an improved system for recovering flax fiber from straw.

SUMMARY OF THE INVENTION

I have now invented an improved apparatus and method for separating foreign matter from fibers with significantly reduced fiber damage. The apparatus includes:

a) a first housing having an inlet for delivering the fiber containing material therein, and an outlet for discharging partially treated fiber therein;

b) a separation surface positioned within the first housing, which surface includes apertures therethrough which are effective for allowing passage of the foreign matter;

c) a plurality of rotatable first separator cylinders positioned in succession within the first housing above the separation surface, which cylinders include a plurality of projections extending therefrom which are effective for temporarily engaging, moving, and centrifugally releasing therefrom the fibers in the material; the cylinders rotate in the same angular direction such that as the material is engaged by the projections it is transported by successive cylinders through the housing, across the separation surface, and through the outlet;

d) a second housing having an inlet in communication with the outlet of the first housing for receiving partially treated fiber therefrom;

e) a rotatable second separator cylinder disposed in the second housing, which cylinder includes a plurality of projections extending therefrom which are effective for securely engaging and transporting fibers in the material on the cylinder;

f) one or more cleaning bars disposed in the second housing adjacent to the second separator cylinder, such that fibers pass between the cylinder and cleaning bar, while foreign matter in the material is impacted by the bars and removed; and g) a doffing means for removing said fiber from the projections on the second separator cylinder, which first doffing means may include air blast, vacuum, and a first doffing brush cylinder, wherein the first doffing brush cylinder has an outer peripheral surface operably associated with and rotating in the opposite angular direction as the second separator cylinder, which is effective for mechanically removing the fiber from the projections on the second separator cylinder.

Fiber containing material for treatment is introduced into the first housing in contact with the rotating first separator cylinders. As the fibers are engaged by the projections on the cylinders, the material is both agitated and transported or pulled across the separation surface below the cylinders. The movement of the material across and against this surface effectively scrubs the material, dislodging foreign matter within the material which matter then falls by gravity through the apertures in the surface. In contrast, the fibers engaged by the projections are released therefrom by the centrifugal force generated by the rotating cylinders, thereby conveying the material to successive downstream cylinders in the housing and repeatedly subjecting the material to the cleaning action. Once the fiber containing material is engaged by the last separator cylinder, this partially cleaned material is propelled off of the revolving cylinder toward and through the outlet of the first housing, and directly into the second housing. In a preferred embodiment, propulsion of the partially treated material through the outlet and into the second housing is assisted by providing one or more optional, outwardly extending wipers or paddles on the last separator cylinder.

Fibers in the partially cleaned material delivered into the second housing are seized by and retained on the projections of the second separator cylinder. As the cylinder rotates, the material is transported past the cleaning bars. The fibers retained on the rotating cylinder are subjected to further cleaning to remove any remaining foreign matter by a combination of centrifugal force, the scrubbing action between the cylinder and cleaning bars, and gravity. After the fibers on the cylinder have passed the cleaning bars, the cleaned fibers are removed from the cylinder by the doffing means, whereupon they may be recovered and supplied to a baling machine and/or further treated.

In accordance with this invention, it is an object to provide an improved process and apparatus for removing foreign matter from fibers.

Another object of the invention is to provide an improved cleaner effective for treatment of fiber from cotton or flax.

A further object of the invention is to provide an improved cleaner for effectively cleaning fiber with significantly reduced damage and fiber loss.

Yet another object of the invention is to provide an improved saw-type lint cleaner without any of the condenser, compression rollers, or feed roller and feed plate which are present on conventional lint cleaners.

Still another advantage of the invention is to provide a single cleaner that achieves all the cleaning of flax necessary to produce a usable fiber from chopped straw.

Other objects and advantages of the invention will become readily apparent from the ensuing description.

DETAILED DESCRIPTION OF THE INVENTION

The apparatus and method of this invention are effective for cleaning foreign materials from a variety of textile fibers, including but not limited to cotton, flax, polyester and nylon. In the preferred embodiments, the apparatus and method are used for cleaning seed flax straw or stalk, particularly seed flax straw chopped in a forage harvester, and most preferably flax straw free of seeds and approximately two inches in length, or cotton fiber recovered from gin stands in the ginning operation, as an alternative to cleaning with conventional controlled-batt saw lint cleaners, or recovering fibers from pulverized or comminuted tires. In these preferred embodiments, the cotton mixture typically comprises from about 1 percent by weight to about 10 percent by weight of foreign matter, whereas the flax mixture often contains about 70 percent by weight of foreign matter.

Figure 1:
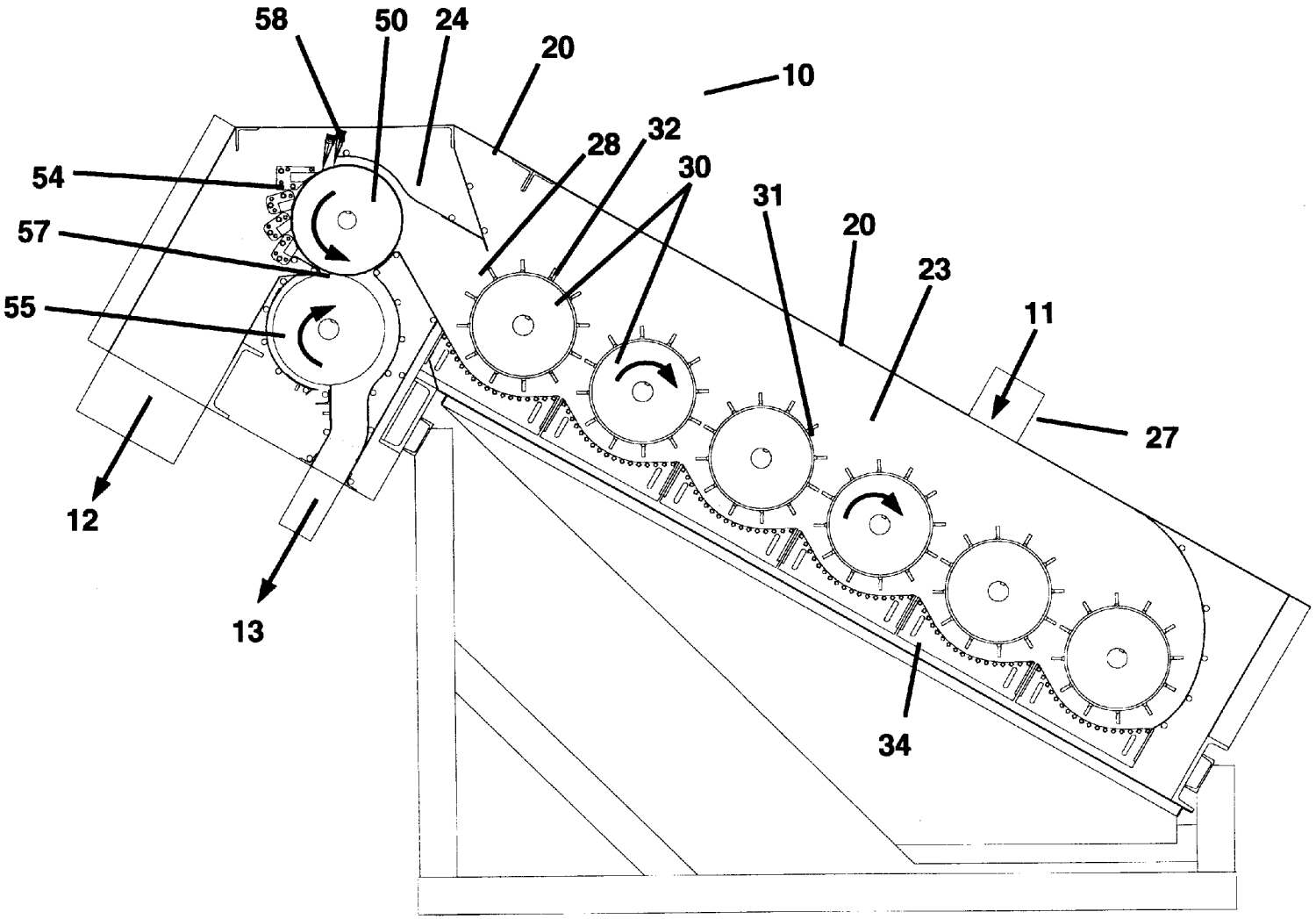
FIG. 1 is a side cross-sectional view of a system for separating fibers from a mixture in accordance with the present invention.

Referring in detail now to the drawings wherein similar parts of the invention are identified by like reference numerals, there is seen an apparatus 10 for receiving a mixture 11 including foreign matter 12 and fibers 13 (FIG. 1). Apparatus 10 is used for separating the foreign matter from the fibers, and thus, foreign matter 12 corresponds generally to plant parts and other contaminants while the fibers 13 generally correspond to cotton, flax, polyester or the like.

The apparatus 10 includes a housing 20 which preferably includes a primary separation zone or a first separator in first housing 23 and a second separation zone in second housing 24. An inlet chute 27 connects to housing 20 and communicates with first separator 23 to provide a path for introducing mixture 11 into first housing 23. Preferably, inlet chute 27 is a chute for feeding a mixture into the primary separation zone. First housing 23 further includes an outlet 28 for discharging partially treated fiber therefrom.

The first separator includes a series of first separator cylinders 30 that extend through, and that are rotatably supported by, first housing 23 while being rotatably driven by one or more motors (not shown), preferably variable speed motors. Each cylinder 30 has a plurality of projections 31 protruding outwardly therefrom for contacting and temporarily engaging mixture 11 to separate fibers 13 from foreign matter 12 and to produce an intermediate mixture of residual fibers and foreign matter 12. The projections are also adapted to centrifugally release the fibers therefrom as the cylinder rotates without assistance from a doffing brush. As used herein, "centrifugally releasable fiber-engaging projections" refers to projections which are capable of engaging any fibers, either pure or in a mixture with non-fibrous contaminants, and releasing, propelling, or impelling the same because of or due to centrifugal force caused by the revolving or rotating cylinder assemblies. The centrifugally releasable projections in the first separation zone preferably comprise a plurality of generally identical projections, which may radiate from the cylinder or may be positioned at an angle to the radii of the cylinder. Without being limited thereto, projections which are suitable for use herein include spikes, course approximately triangular shaped teeth, rods, angles, straight or curved tines, flanges, rods or the like. The size of the projections is not critical. The length of the projections, their spacing on the cylinders, and the speed of rotation of the cylinders may vary with the type of fiber and desired throughput, and may be determined by the skilled practitioner. In the preferred embodiment, projections 31 preferably have a length ranging from about one inch to about three inches and preferably possess a diameter ranging from about ¼ inch to about ¾ inch. Preferably, cylinders 30 are approximately 12 to 18 inches in diameter and revolve at from about 300 r.p.m. to about 1200 r.p.m. For treatment of cotton fibers, preferred speeds may range between about 900 to about 1200 r.p.m., while flax is preferably treated at speeds between about 500 to about 600 r.p.m. The number of cylinders 30, may vary similarly. However, in the preferred embodiments, without being limited thereto, the number of cylinders 30 will be between 6 and 15.

The last or furthermost downstream cylinder 30 also preferably includes optional outwardly extending wipers or paddles 32. Additional wipers (shown in FIG. 4) may also be provided on the upstream cylinders 30. The shape of wipers 32 is also not critical. The wipers 32 may have a variety of shapes, including but not limited to elongated planar or curved surfaces or angles extending partially or approximately completely across the length of the cylinder, and may also radiate from the cylinder or be positioned at an angle to the radii of the cylinder, and they may be constructed from rigid, semi-rigid, or resilient materials. The length, height and number of wipers on the cylinders, may also vary, but should be sufficient to engage and propel the mixture 11.

First housing 23 further includes separating surfaces 34 disposed below the first separator cylinders 30 and in close proximity to projections 31 of those cylinders. The shape of the surfaces 34 and the spacing between the surfaces and cylinders are selected such that the rotation of the cylinder is effective to scrub the mixture 11 against the surface to dislodge the foreign matter 12 which may then fall through the apertures or openings therein. In the preferred embodiment, without being limited thereto, the ends of projections 31 rotatingly pass above the separating surfaces at a distance ranging from about ⅛ inch to about one inch, while wipers 32 preferably pass the separating surfaces at a range from about 1/32 inch to about 1/16 inch. Separating surfaces 34 may be any suitable surface that is capable of cooperating with projections 31 to assist in separating foreign matter 12 from fibers 13 to produce foreign matter/residual fiber mixture. Preferably, separating surfaces 34 are provided with apertures or openings therethrough which are effective for allowing foreign matter 12 and intermediate mixture pass after being separated from mixture 11.

Figure 2:
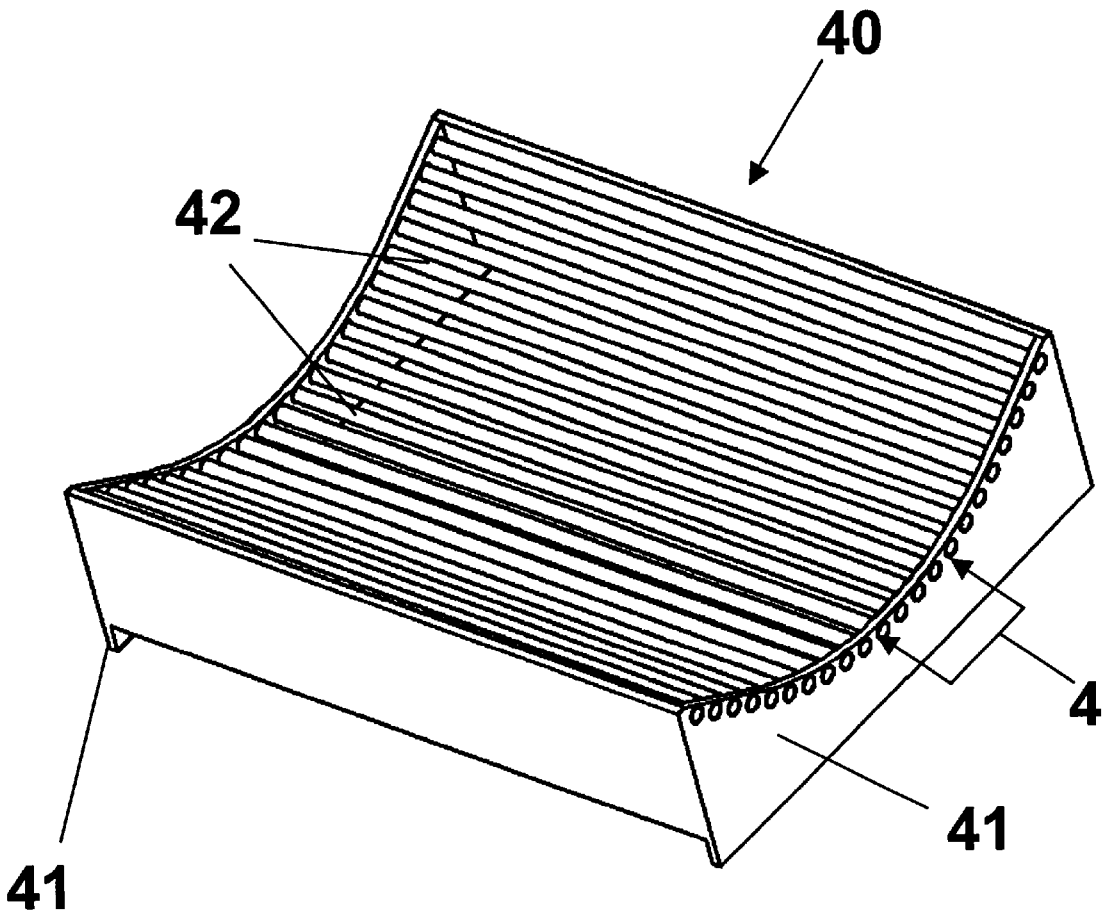
FIG. 2 is a partial enlarged perspective view of a concave grid-bar structure for the system illustrated in FIG.
Figure 3:
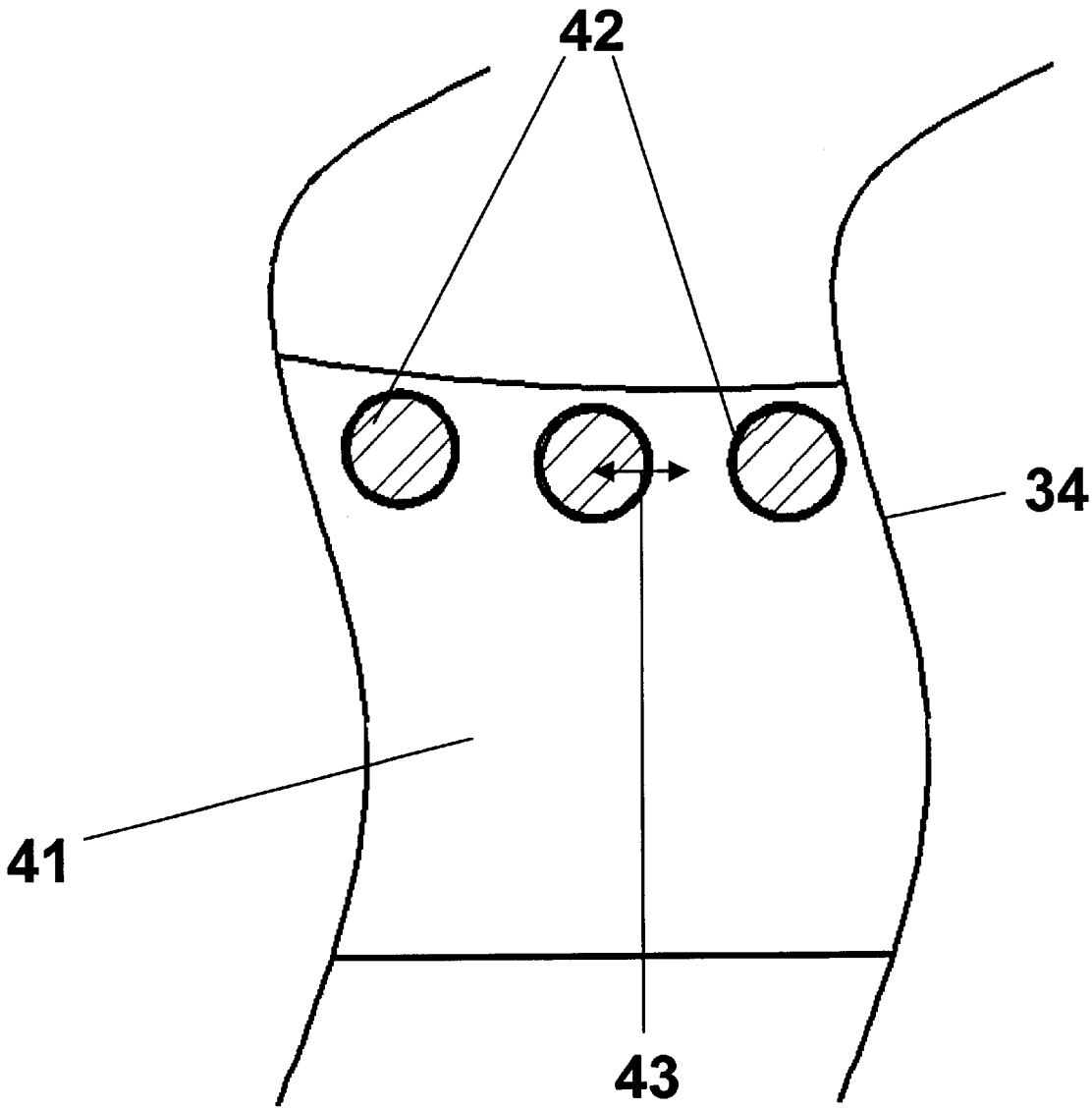
FIG. 3 is a vertical sectional view taken in the direction of the arrows and along the plane of line 4 in FIG. 2.

A variety of surfaces are suitable for use herein, and include but are not limited to parallel, spaced rods or bars, screens, grids, mesh or woven wire, and continuous sheets of material such as metal or polymers having perforations therethrough. In a preferred embodiment shown in FIGS. 2–4, separating surfaces 34 are concave with a discontinuous separation surface 40 having a pair of generally parallel arcuate brackets 41 interconnected by a plurality of parallel spaced rods 42. The spaced rods 42 are preferably separated by an opening or space 43 that has a dimension preferably ranging from about ⅛ inch to about ¾ inch, while the rods generally have a diameter ranging from about ¼ inch to about ¾ inch. In operation, the projections 31 of revolving spiked cylinders 30 contact the mixture 11 and engage fibers 13 that have entrained and/or adherent foreign matter 12. While projections 31 are engaged with mixture 11 and are being rotated, they rub and/or scrub the projection-engaged mixture 11 against spaced rods 42 of concave grid rod structures 40, thereby causing fibers 13 and entrained and adherent foreign matter 12 to separate from rod-engaged mixture 11. Separated foreign matter 12 falls through spaces 43 between the contiguously spaced rods 42. A collection chamber and/or transport conduit may be provided below separating surfaces 34 for gathering and transporting the foreign matter 12 for subsequent disposal.

Figure 4:
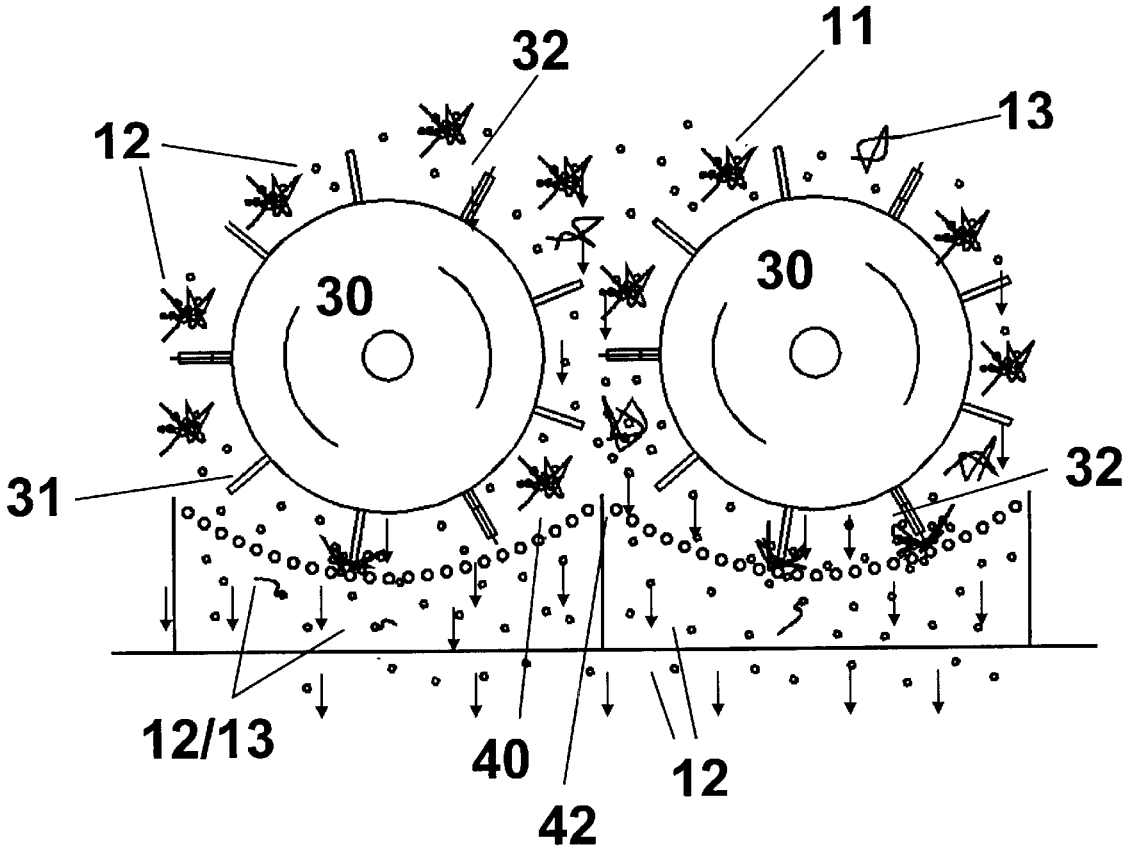
FIG. 4 is an enlarged end elevational view of a pair of rotating cylinders having rods protruding therefrom of the system of FIG. 1.

After mixture 11 has been scrubbed through the process of being brought into contact against spaced rods 42, revolving projections 31 throw or propel scrubbed mixture 11 onto revolving projections 31 of the next adjacent revolving cylinder 30. The centrifugal force from one rotating cylinder 30 causes mixture 11 to slide off the projections and be engaged by the rotating projections of the adjacent rotating cylinder 30, as best shown in FIG. 4. The process of scrubbing and subsequently propelling mixture 11 is continued until the last of the series of revolving cylinders 30 is reached, whereupon the remaining mixture, which at this point is fibers and residual foreign matter, is passed directly to the second separation cylinder 50 in second housing 24. Delivery of the remaining mixture from the primary separation zone in the first housing 23 into the second separation zone in second housing 24 is facilitated by wipers 32 on the furthermost downstream cylinder 30. Wipers 32 help scrub the mixture 11 along separating surfaces 34, and propel fibers and any mixture which do not fall through spaces 43 onto the second separation cylinder 50.

Although the device may be operated using a single first separator, the skilled practitioner will recognize that a plurality of first separator units may be disposed in series for greater cleaning, or in parallel for increased throughput, or additional units may be provided for recycling recovered material.

A description of cylinder cleaners which may be suitably adapted for use herein as a first separator in this invention are described by Anthony, W. S., et al. (Editors, *Cotton Ginner's Handbook*, ibid, pp. 70–75, the contents of which are incorporated by reference herein).

Figure 5:
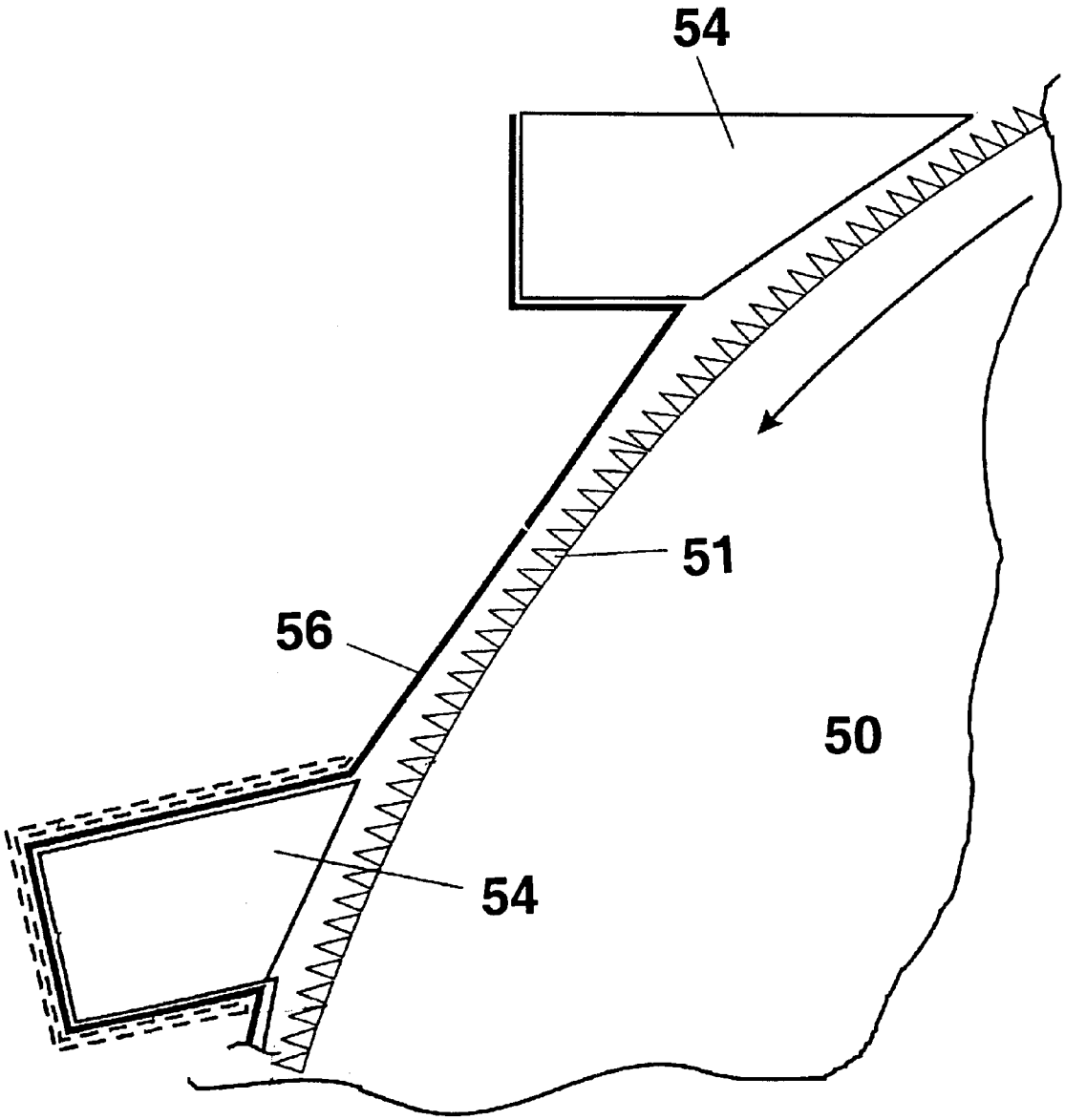
FIG. 5 is an enlarged end view of a second separator cylinder with associated cleaning bars and optional shroud.

The second separator in second housing 24 contains a second separator cylinder 50 that is rotatably supported in the housing 20 and rotatably driven by one or more motors, preferably variable speed motors (not shown). Cylinder 50 has a plurality of outwardly extending projections 51 (FIG. 5) for contacting and engaging the partially cleaned fiber to separate fibers from the residual foreign matter 12. In contrast to the projections 31 on the first separator cylinders 30, projections 51 are adapted to seize and retain the fibers as the cylinder 50 rotates at high speed. The fibers are retained on projections 51 and are not released solely by action of centrifugal force alone but require mechanical assistance such as from doffing brushes. Without being limited thereto, projections 51 which are suitable for use herein include toothed wire, saw teeth or hooks. Cylinder 50 and projections 51 are preferably conventional fiber cleaning saw cylinders, having diameters between approximately 12 to 24 inches, and which are operated at from about 600 r.p.m. to about 1400 r.p.m., and more preferably, from about 900 r.p.m. to about 1200 r.p.m. In a preferred embodiment, one or more optional baffles, shrouds, or brushes 58 may be provided near the outer periphery of the second separator cylinder 50, positioned effective to direct the fiber propelled from the first housing 23 onto the surface of cylinder 50.

Second housing 24 further includes one or more cleaning bars 54 that extend adjacent to, and in parallel with, cylinder 50. The cleaning bars typically extend substantially across the length of the cylinder 50, and are spaced sufficiently near to the projections 51 of the cylinder that foreign matter 12 impacts against the bars. Without being limited thereto, in the preferred embodiment, the cleaning bars are grid bars as used on conventional saw-type lint cleaners, such as described by Anthony, W. S., et al. (Editors, *Cotton Ginner's Handbook*, ibid, pp. 103–113, the contents of which are incorporated by reference herein). The selection of the number of grid bars and their spacing from the cylinder 50 may be readily determined by the skilled practitioner.

In accordance with another preferred embodiment, second separator cylinder 50 and cleaning bars 54 are constructed and provided with a fixed or adjustable shroud or louver 56 (see FIG. 5) as described in Anthony (U.S. Pat. No. 5,909,786, the contents of which are incorporated by reference herein). Shrouds may be readily installed and selectively activated to eliminate one or more cleaning bars 54 from cleaning action if the fiber is sufficiently clean.

Foreign matter 12 removed by the cleaning bars may be discarded or subjected to further processing as described below. The fiber remaining on the cylinder 50 after passing the cleaning bars contains substantially less foreign matter. To recover the fiber from the cylinder, second housing 24 preferably further includes a first doffing brush cylinder 55 having an outer peripheral surface operably associated with and rotating in the opposite angular direction as the second separator cylinder 50, and which is effective for mechanically removing the fiber from the projections on the second separator cylinder 50. Although any conventional doffing brush may be used, including those with brush sticks, use of a solid face brush such as a spiral wound doffing brush is preferred to significantly reduce noise levels (see Anthony, W. S., et al., Editors, *Cotton Ginner's Handbook*, ibid, pp. 98–99, 104–105, and 284–285, the contents of which are incorporated by reference herein). The tip speed of the first doffing brush cylinder must be greater than the tip speed of the projections 51 on the second separation cylinder 50 for effective removal of the fiber therefrom, with brush tip speeds preferably being approximately 1.5 to 2 times the tip speed of the second separator cylinder. In the alternative to doffing brush cylinders, it is envisioned that the fibers may be removed from the second separation cylinder pneumatically by suction or air blast as is known in the art. Fiber removed from the second separator cylinder 50 may then be collected for baling or further treated or cleaned.

Figure 6:
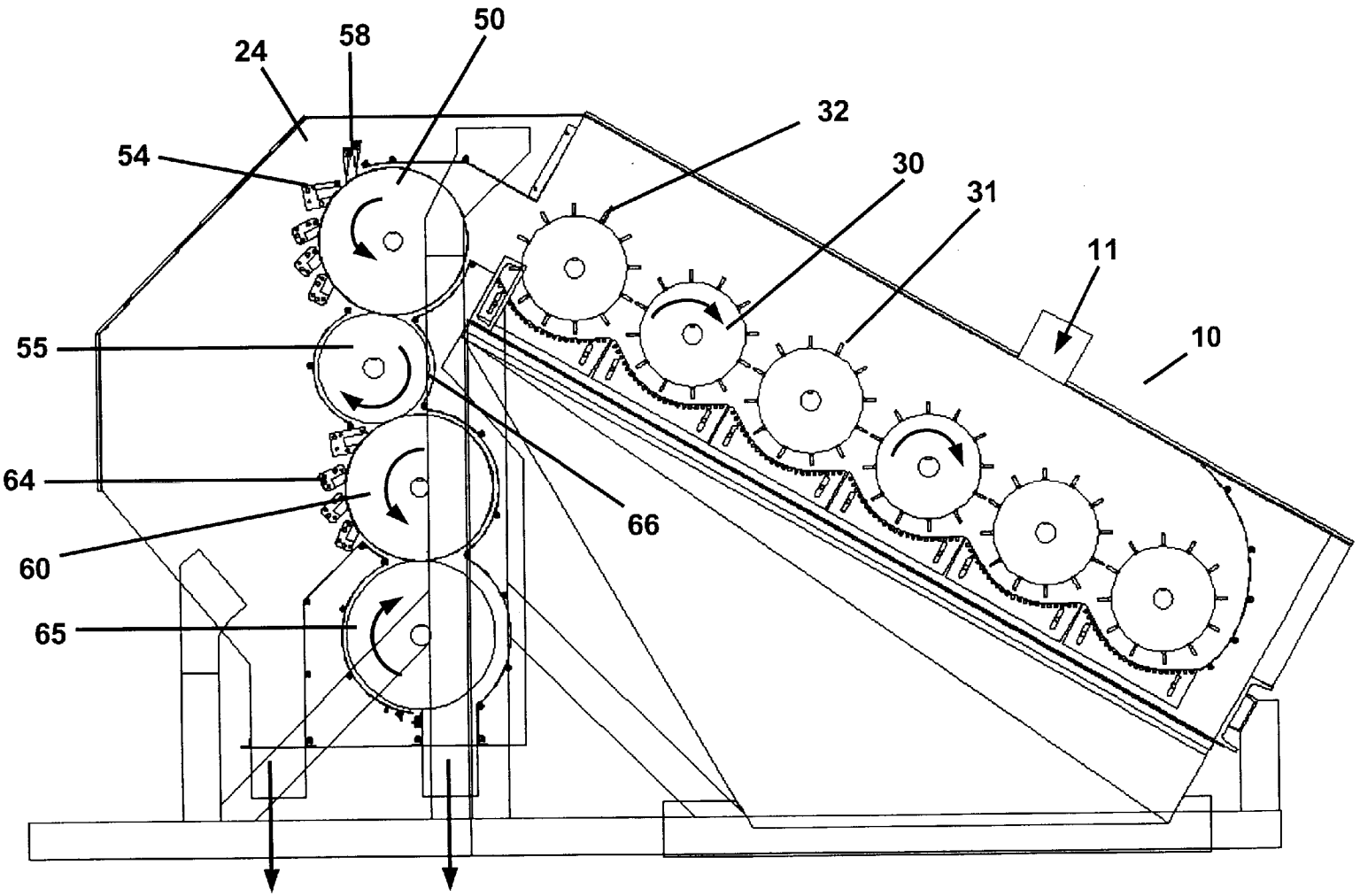
FIG. 6 is a side cross-sectional view of a system for separating fibers from a mixture in accordance with another embodiment of the present invention.

In one alternative embodiment shown in FIG. 6, a third separator cylinder 60 (with cooperating second cleaning bars 64), and a second doffing brush cylinder 65 are provided downstream of the first doffing brush cylinder 55. The construction of the third separator cylinder 60, cleaning bars 64, and second doffing brush cylinder 65 may be substantially the same as described hereinabove for the second separator cylinder 50, cleaning bars 54, and the first doffing brush cylinder 55, respectively. Optional fixed or adjustable shrouds or louvers may also be provided in combination with this third separation cylinder 60 and cleaning bars 64 as described for use with the second separator cylinder 50 hereinabove. Moreover, in a modification of this embodiment, the fiber may be removed or doffed from the second separator cylinder 50 with a cylinder other than a doffing brush. It is understood that a doffing cylinder, which may be a saw or other separator cylinder such as described for the second separator cylinder above, may be substituted for first doffing brush cylinder 55, provided that this doffing cylinder is also rotating at a faster speed than second separator cylinder 50, but slower than third separator cylinder 60. In this adaptation, the doffing cylinder 55 may effectively doff the second separator cylinder 50, and then itself be doffed by the third separator cylinder 60.

To direct the flow of fiber removed from the second separator cylinder 50 by the first doffing brush 55 into engagement with the projections on the third separator cylinder 60, a shroud or flow guide 66 may be provided between the pinch point 57 of the second separator cylinder with the first doffing brush, extending therefrom parallel to the periphery of the doffing brush cylinder 55 in the downstream direction of fiber flow to the third separator cylinder 60. The third separator cylinder 60 is positioned adjacent to the first doffing brush cylinder 55 such that the outer peripheral surface of the brush is operably associated with and rotating in the same angular direction as the third separator cylinder 60. Thus, after the cleaned fiber is removed from the second separator cylinder 50 the fiber flow is directed into contact with and engaged by the projections of the third separator cylinder 60. The fiber on the third separator cylinder 60 is then carried across t-he cleaning bars 64 to remove any residual foreign matter, and then to second doffing brush cylinder 65 (or other pneumatic doffing mechanism) whereupon the fiber is removed and recovered.

Figure 7:
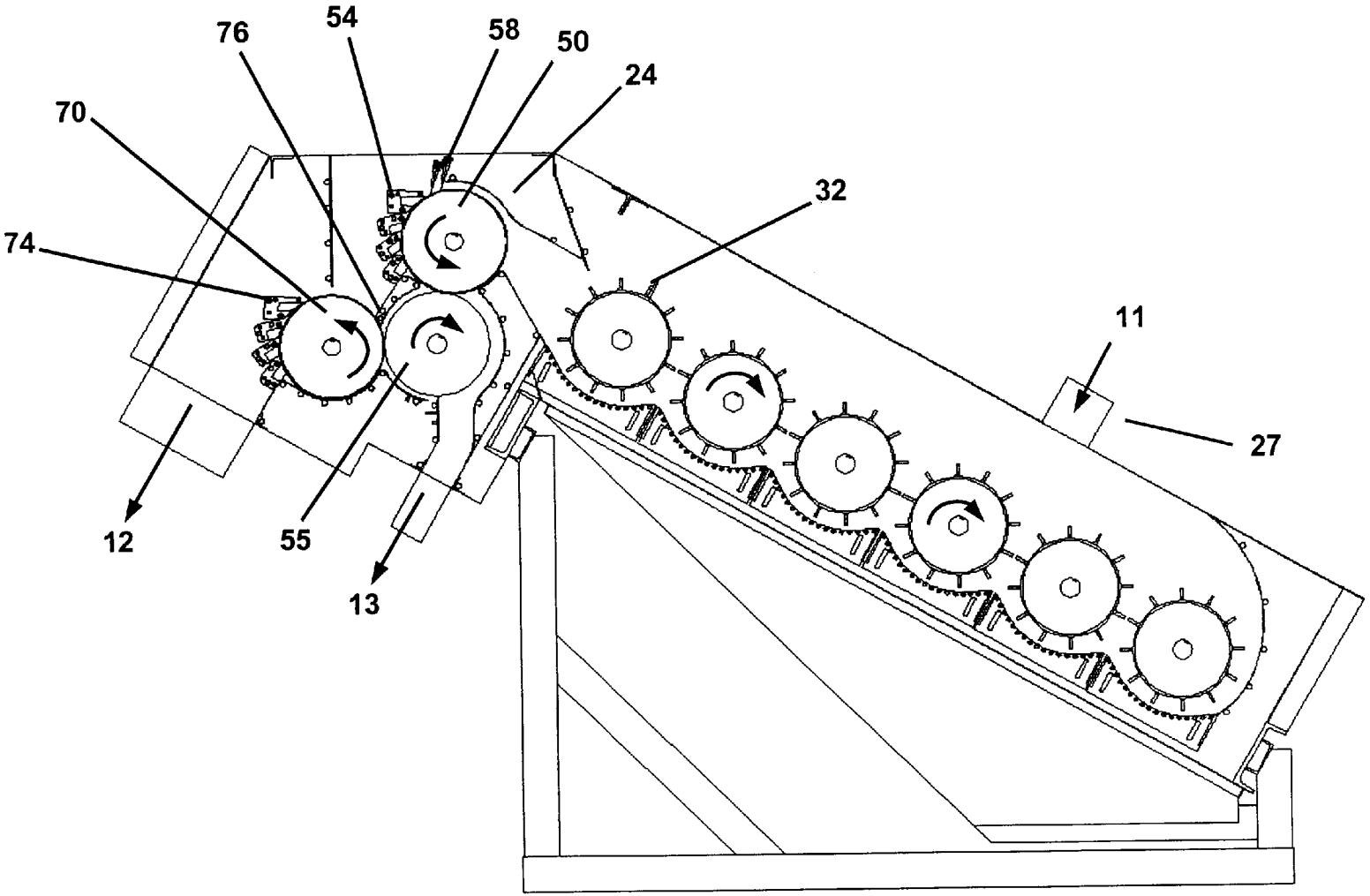
FIG. 7 is a side cross-sectional view of a system for separating fibers from a mixture in accordance with yet another embodiment of the present invention.
Figure 8:
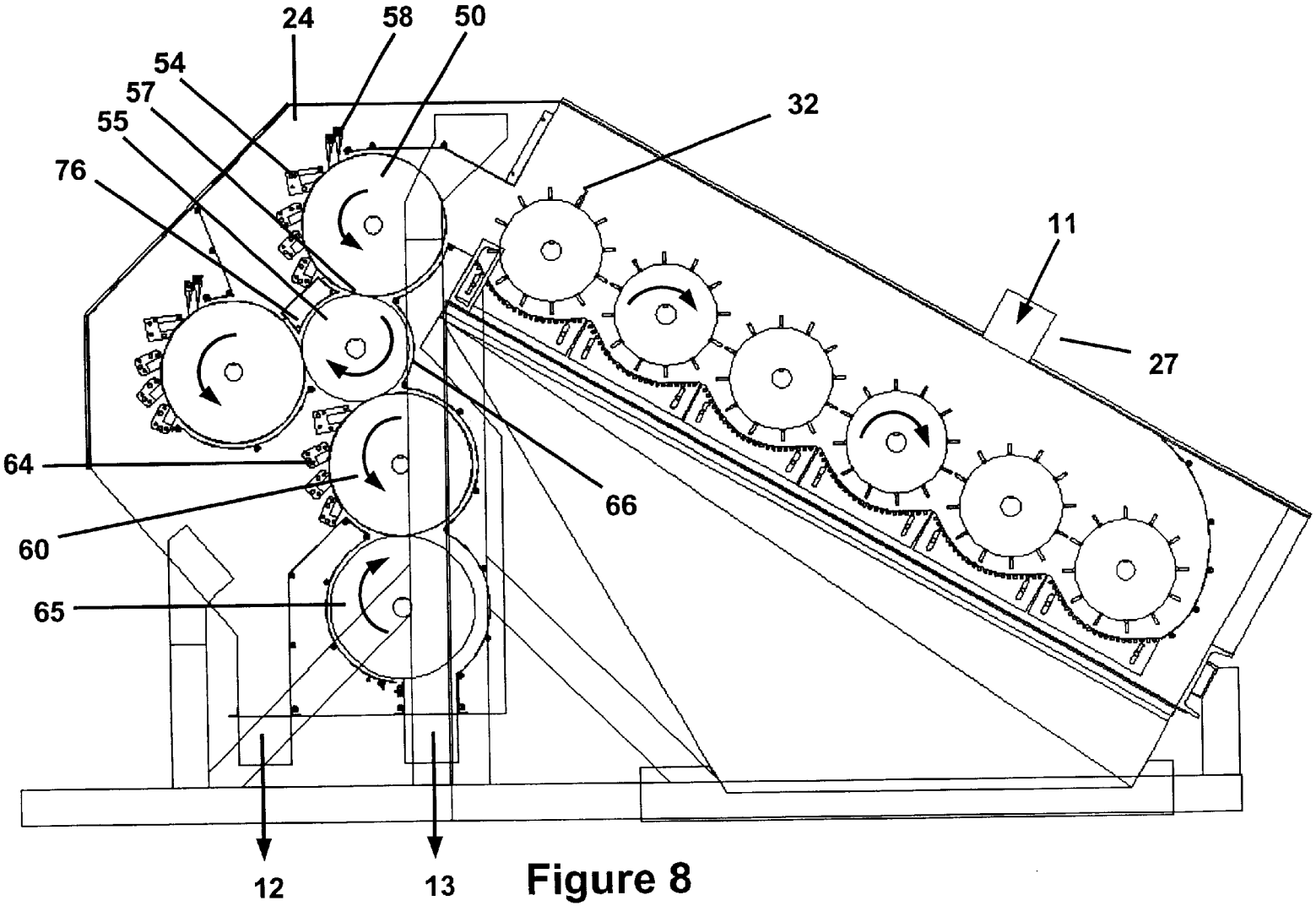
FIG. 8 is a side cross-sectional view of a system for separating fibers from a mixture which includes the components of the embodiments of FIGS. 6 and 7 in a first arrangement.
Figure 9:
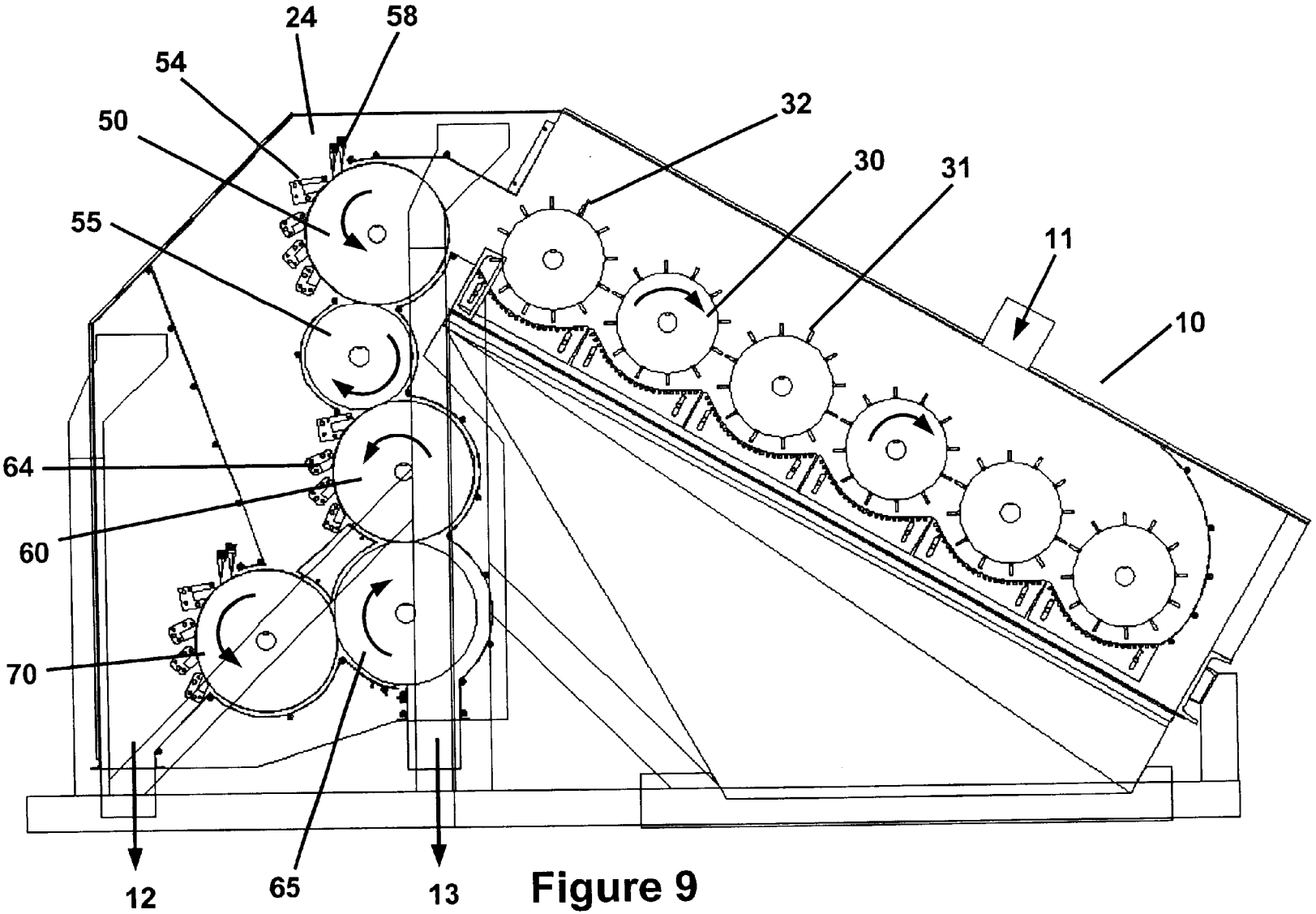
FIG. 9 is a side cross-sectional view of another system for separating fibers from a mixture which includes the components of the embodiments of FIGS. 6 and 7 in a second arrangement.
Figure 10:
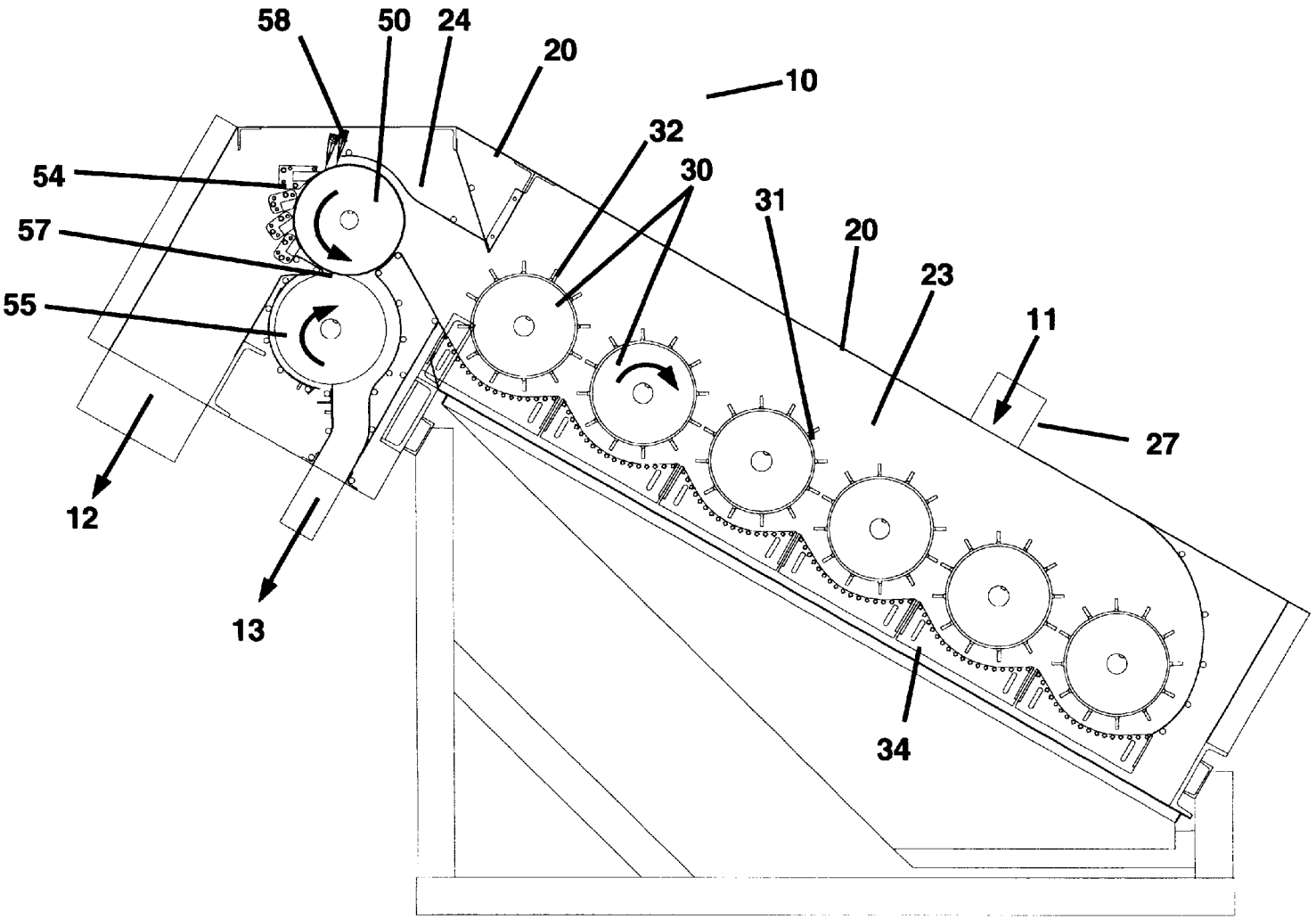
FIG. 10 is a side cross-sectional view of a system for separating fibers from a mixture in accordance with the present invention wherein the first and second housings are separate.

In another alternative embodiment shown in FIG. 7, the second housing 24 is provided with a fourth or reclaiming separator cylinder 70 (with cooperating cleaning bars 74) for cleaning the material removed by cleaning bars 54 and retrieving fiber therein. This embodiment may be used alone (FIG. 7) or in combination with the third separator cylinder 60 and second doffing brush cylinder 65 of the above-mentioned alternative embodiment as shown in FIG. 8 or 9 and described in greater detail hereinbelow. Again, the construction of the fourth separator cylinder 70 and cleaning bars 74 may be substantially the same as described hereinabove for the second separator cylinder 50 and cleaning bars 54. Further, while the use of a solid face doffing brush with short bristles is preferred, other conventional doffing brushes may also be used, or a doffing cylinder such as a saw or other separator cylinder, may also be substituted for first doffing brush cylinder 55 as described above. The position of the fourth separator cylinder 70 relative to the cleaning bars 54 is not critical provided the cylinder is positioned where it can engage the material as it falls or is removed from the cleaning bars. Thus the fourth separator cylinder 70 may be positioned directly below the cleaning bars 54 so as to contact material falling therefrom by gravity, or it may be positioned elsewhere in the housing with the material being transported or channeled thereto. However, the position of the fourth separator cylinder 70 relative to the first doffing brush cylinder 55 is critical.

The fourth separator cylinder 70 is positioned adjacent to the first doffing brush cylinder 55 such that the outer peripheral surface of the brush is operably associated with and rotating in the opposite angular direction as the fourth separator cylinder 70. It is also understood that the outer tip speed of doffing brush cylinder 55 should be greater than the outer tip speed of the fourth separator cylinder 70. In this embodiment, the single doffing brush cylinder 55 may be used to effectively remove cleaned fiber from two different separator cylinders, i.e., second cylinder 50 and fourth cylinder 70. As shown in FIG. 7, fiber is removed from the fourth separator cylinder by doffing brush cylinder 55 and channeled along the periphery of the doffing brush cylinder by shroud or flow guide 76 to pinch point 57. The fiber moves across or through pinch point 57 whereupon it is combined with the fiber removed from the second separator cylinder 50.

While the fourth, reclaiming separator cylinder 70 may be used alone, in further alternative embodiments it may also be used in combination with the third separator cylinder 60. In a first such combination shown in FIG. 8, third cylinder 60 (with cooperating cleaning bars 64, and second doffing brush 65 or other pneumatic doffing means) and fourth cylinder 70 are each positioned as described in FIGS. 6 and 7, respectively. In this configuration, third and fourth separator cylinders function as described above, with the fourth cylinder 70 reclaiming fiber from the discarded material removed from second separating cylinder 50 by cleaning bars 54.

In an alternative configuration shown in FIG. 9, fourth cylinder 70 may be positioned to engage and retrieve any fiber in the waste material removed from the third separator cylinder 60 by the cleaning bars 64. In this embodiment, the fourth separator cylinder is located where it can engage the material as it falls or is removed from cleaning bars 64. To provide for the doffing of retrieved fiber from the fourth separator cylinder 70, the fourth cylinder is also positioned adjacent to the second doffing brush cylinder 65 such that the outer peripheral surface of the brush is operably associated with and rotating in the opposite angular direction as the fourth separator cylinder 70. For use in this embodiment, second doffing brush cylinder 65 may be constructed in the same manner as described for the first doffing brush 55 in the embodiment of FIG. 7, and again, the outer tip speed of doffing brush cylinder 65 should be greater than the outer tip speed of the fourth separator cylinder 70. As in the embodiment of FIG. 7, in this embodiment, the second doffing brush cylinder 65 may be used to effectively remove cleaned fiber from two different separator cylinders. However, in contrast to the embodiment of FIG. 7, the second doffing brush 65 in the embodiment doffs the fiber from third cylinder 60 and fourth cylinder 70.

Thus, in overall operation, mixture 11 is introduced into the first separator in first housing 23 through inlet chute 27. The introduction of mixture 11 may be in any suitable manner, such as gravity feeding, pneumatically, mechanically conveying, etc.

In the figures, the arrows inside each cylinder represent the direction of rotation of that cylinder, and hence the direction of rotation of projections and wipers attached thereon. Mixture 11 travels over the rotating cylinders and is propelled to the right due to the clockwise rotation of the cylinders. Some of the mixture may fall in between the rotating cylinders. Mixture 11 then passes around the right most cylinder, and is then propelled under the rotating cylinders and brought into contact between the cylinder projection and the concave separation structure 40.

As mixture 11 is propelled under the revolving cylinders and against the discontinuous concave separation structure 40, foreign matter 12 begin separating from mixture 11 and fall through spaces 43 into a transport duct for disposal, recycling, or further treatment. Mixture 11 continues moving through first housing 23 and by virtue of its transit past the multiple cylinder separation surface interfaces, gradually becomes a mixture consisting primarily of fibers and residual foreign matter. This intermediate mixture is propelled into the second separator in second housing 24 where even more foreign matter is separated out.

It is understood that the foregoing detailed description is given merely by way of illustration and that modifications and deviations may be made therein without departing from the spirit and scope of the invention.

I claim:

1. An apparatus for separating foreign matter from a fiber containing material comprising:

a) a first housing, said first housing comprising an inlet therein for delivering a fiber containing material for separation therein, and an outlet for discharging partially treated fiber therefrom;

b) a separation surface positioned within said first housing, said surface having apertures therethrough effective for allowing passage of foreign matter in said fiber containing material, wherein said outlet for discharging partially treated fiber is disposed above said separation surface;

c) a plurality of rotatable first separator cylinders positioned within said first housing above said separation surface, said first separator cylinders comprising a plurality of projections extending therefrom effective for engaging, moving, and centrifugally releasing therefrom fibers in said fiber containing material, said first separator cylinders rotating in the same angular direction such that said fiber containing material is transported through said first housing, across said separation surface, and through said outlet upon engagement by said projections and rotation of said first cylinders, while said foreign matter separated from said fiber containing material passes through said apertures;

d) a second housing, said second housing comprising an inlet in communication with said outlet of said first housing for receiving said partially treated fiber, a first outlet for treated fiber, and a second outlet for foreign matter;

e) a rotatable second separator cylinder disposed in said second housing, said second separator cylinder comprising a plurality of projections extending therefrom effective for securely engaging and transporting fibers in said fiber containing material on said second separator cylinder;

f) a first cleaning bar disposed in said second housing, wherein said first cleaning bar is disposed adjacent said second separator cylinder such that fibers pass between said second separator cylinder and said first cleaning bar, whereby said first cleaning bar removes foreign matter from said fiber containing material; and g) a first doffing means for removing said fiber from said projections on said second separator cylinder, said first doffing means selected from the group consisting of air blast, vacuum, and a first doffing brush cylinder, wherein said first doffing brush cylinder has an outer peripheral surface operably associated with said second separator cylinder effective for mechanically removing said fiber from said projections on said second separator cylinder, said first doffing brush cylinder rotating in the opposite angular direction as said second separator cylinder.

2. The apparatus of claim 1 wherein the furthermost downstream of said rotatable first separator cylinders further comprises outwardly extending wipers effective for propelling said fiber containing material upon rotation of said first separator cylinders.

3. The apparatus of claim 2 wherein said wipers on said first separator cylinders are selected from the group consisting of elongated planar surfaces, curved surfaces, and angles, and said wipers extend partially or approximately completely across the length of said furthermost downstream of said first separator cylinders.

4. The apparatus of claim 1 wherein said first housing and said second housing are unitary.

5. The apparatus of claim 1 wherein said first housing and said second housing are separate.

6. The apparatus of claim 1 wherein said outlet of said first housing and said inlet of said second housing are in direct communication.

7. The apparatus of claim 1 wherein said projections on said second separator cylinder are selected from the group consisting of toothed wire, saw teeth, and hooks.

8. The apparatus of claim 1 wherein said projections on said first separator cylinder are selected from the group consisting of spikes, course approximately triangular shaped teeth, rods, angles, straight or curved tines, flanges, and rods.

9. The apparatus of claim 1 wherein said separation surfaces are selected from the group consisting of parallel, spaced bars, screens, grids, mesh, and continuous sheets of material having perforations therethrough.

10. The apparatus of claim 1 wherein said separation surfaces are concave.

11. The apparatus of claim 1 wherein said first doffing means comprises said first doffing brush cylinder.

12. The apparatus of claim 11 wherein said first doffing brush cylinder comprises a solid face doffing brush cylinder.

13. The apparatus of claim 11 further comprising h) a third separator cylinder positioned in said second housing, said third separator cylinder comprising a plurality of projections extending therefrom effective for securely engaging and transporting fibers in said fiber containing material on said third separator cylinder, wherein said third separator cylinder is positioned adjacent to said first doffing brush cylinder such that the outer peripheral surface of said doffing brush cylinder is operably associated with and rotating in the opposite angular direction as said third separator cylinder;

i) a second cleaning bar disposed in said second housing, wherein said second cleaning bar is disposed adjacent to said third separator cylinder' such that fibers pass between said third separator cylinder and said second cleaning bar, whereby said second cleaning bar removes foreign matter from said fiber containing material; and j) a second doffing means provided downstream of said first doffing brush cylinder for removing said fiber from said projections on said third separator cylinder, said second doffing means selected from the group consisting of air blast, vacuum, and a second doffing brush cylinder, wherein said second doffing brush cylinder has an outer peripheral surface operably associated with said third separator cylinder effective for mechanically removing said fiber from said projections on said third separator cylinder, said second doffing brush cylinder rotating in the opposite angular direction as said third separator cylinder.

14. The apparatus of claim 13 wherein said second doffing means comprises said second doffing brush cylinder.

15. The apparatus of claim 13 further comprising a shroud extending between the pinch point of said second separator cylinder with said first doffing brush cylinder, parallel to the periphery of said first doffing brush cylinder, to said third separator cylinder, said shroud being effective to direct the flow of fiber removed from said second separator cylinder by said first doffing brush cylinder into engagement with said projections on said third separator cylinder.

16. The apparatus of claim 13 further comprising:

k) a fourth separator cylinder positioned in said second housing, said fourth separator cylinder comprising a plurality of projections extending therefrom effective for securely engaging and transporting fibers in said fiber containing material on said fourth separator cylinder, wherein said fourth separator cylinder is positioned to engage said foreign matter removed from said second separator cylinder by said first cleaning bar, and is further positioned adjacent to said first doffing brush cylinder such that the outer peripheral surface of said first doffing brush cylinder is operably associated with and rotating in the opposite angular direction as said fourth separator cylinder; and l) a third cleaning bar disposed in said second housing, wherein said third cleaning bar is disposed adjacent to said fourth separator cylinder such that fibers pass between said fourth separator cylinder and said third cleaning bar, whereby said third cleaning bar removes foreign matter from said fiber containing material;

wherein said first doffing brush cylinder is effective for simultaneously mechanically removing said fiber from both said projections on said second separator cylinder and said projections on said fourth separator cylinder.

17. The apparatus of claim 13 wherein said outlet of said first housing and said inlet of said second housing are in direct communication.

18. The apparatus of claim 1 further comprising:

k) a fourth separator cylinder positioned in said second housing, said fourth separator cylinder comprising a plurality of projections extending therefrom effective for securely engaging and transporting fibers in said fiber containing material on said fourth separator cylinder, wherein said fourth separator cylinder is positioned to engage said foreign matter removed from said second separator cylinder by said first cleaning bar, and is further positioned adjacent to said first doffing brush cylinder such that the outer peripheral surface of said first doffing brush cylinder is operably associated with and rotating in the opposite angular direction as said fourth separator cylinder; and l) a third cleaning bar disposed in said second housing, wherein said third cleaning bar is disposed adjacent to said fourth separator cylinder such that fibers pass between said fourth separator cylinder and said third cleaning bar, whereby said third cleaning bar removes foreign matter from said fiber containing material;

wherein said first doffing brush cylinder is effective for simultaneously mechanically removing said fiber from both said projections on said second separator cylinder and said projections on said fourth separator cylinder.

19. The apparatus of claim 18 further comprising a shroud extending between the pinch point of said fourth separator cylinder with said first doffing brush cylinder, parallel to the periphery of said first doffing brush cylinder, to the pinch point between said second separator cylinder with said first doffing brush cylinder, said shroud being effective to direct the flow of fiber removed from said fourth separator cylinder by said first doffing brush cylinder to said pinch point between said second separator cylinder with said first doffing brush cylinder, whereupon said fiber removed from said fourth separator cylinder is combined with said fiber removed from said second separator cylinder.

20. The apparatus of claim 18 wherein said outlet of said first housing and said inlet of said second housing are in direct communication.

21. An apparatus for separating foreign matter from a fiber containing material comprising:

a) a first housing, said first housing comprising an inlet therein for delivering a fiber containing material for separation therein, and an outlet for discharging partially treated fiber therefrom;

b) a separation surface positioned within said first housing, said surface having apertures therethrough effective for allowing passage of foreign matter in said fiber containing material;

c) a plurality of rotatable first separator cylinders positioned within said first housing above said separation surface, said first separator cylinders comprising a plurality of projections extending therefrom effective for engaging, moving, and centrifugally releasing therefrom fibers in said fiber containing material, said first separator cylinders rotating in the same angular direction such that said fiber containing material is transported through said first housing, across said separation surface, and through said outlet upon engagement by said projections and rotation of said first cylinders;

d) a second housing, said second housing comprising an inlet in communication with said outlet of said first housing for receiving said partially treated fiber, a first outlet for treated fiber, and a second outlet for foreign matter;

e) a rotatable second separator cylinder disposed in said second housing, said second separator cylinder comprising a plurality of projections extending therefrom effective for securely engaging and transporting fibers in said fiber containing material on said second separator cylinder;

f) a first cleaning bar disposed in said second housing, wherein said first cleaning bar is disposed adjacent said second separator cylinder such that fibers pass between said second separator cylinder and said first cleaning bar, whereby said first cleaning bar removes foreign matter from said fiber containing material;

g) a first doffing cylinder having an outer peripheral surface operably associated with said second separator cylinder effective for mechanically removing said fiber from said projections on said second separator cylinder, said first doffing cylinder rotating in the opposite angular direction as said second separator cylinder;

h) a third separator cylinder positioned in said second housing, said third separator cylinder comprising a plurality of projections extending therefrom effective for securely engaging and transporting fibers in said fiber containing material on said third separator cylinder, wherein said third separator cylinder is positioned adjacent to said first doffing cylinder such that the outer peripheral surface of said doffing cylinder is operably associated with and rotating in the opposite angular direction as said third separator cylinder;

i) a second cleaning bar disposed in said second housing, wherein said second cleaning bar is disposed adjacent to said third separator cylinder such that fibers pass between said third separator cylinder and said second cleaning bar, whereby said second cleaning bar removes foreign matter from said fiber containing material; and j) a second doffing brush cylinder provided downstream of the first doffing cylinder, said second doffing brush cylinder having an outer peripheral surface operably associated with said third separator cylinder effective for mechanically removing said fiber from said projections on said third separator cylinder, said second doffing brush cylinder rotating in the opposite angular direction as said third separator cylinder.

22. The apparatus of claim 21 further comprising:

k) a fourth separator cylinder positioned in said second housing, said fourth separator cylinder comprising a plurality of projections extending therefrom effective for securely engaging and transporting fibers in said fiber containing material on said fourth separator cylinder, wherein said fourth separator cylinder is positioned to engage said foreign matter removed from said third separator cylinder by said second cleaning bar, and is further positioned adjacent to said second doffing brush cylinder such that the outer peripheral surface of said second doffing brush cylinder is operably associated with and rotating in the opposite angular direction as said fourth separator cylinder; and l) a third cleaning bar disposed in said second housing, wherein said third cleaning bar is disposed adjacent to said fourth separator cylinder such that fibers pass between said fourth separator cylinder and said third cleaning bar, whereby said third cleaning bar removes foreign matter from said fiber containing material;

wherein said second doffing brush cylinder is effective for simultaneously mechanically removing said fiber from both said projections on said third separator cylinder and said projections on said fourth separator cylinder.

23. The apparatus of claim 21 wherein said first doffing cylinder comprises a further separator cylinder comprising a plurality of projections extending therefrom effective for securely engaging and transporting fibers in said fiber containing material.

24. The apparatus of claim 21 wherein said outlet of said first housing and said inlet of said second housing are in direct communication.

25. The apparatus of claim 21 wherein said outlet from said first housing for discharging partially treated fiber is disposed above said separation surface.

26. A process for separating foreign matter from a fiber containing material comprising:

a) providing the apparatus of claim 1;

b) rotating said first separator cylinders, second separator cylinder, and doffing brush cylinder;

c) introducing a fiber containing material into said first housing through said inlet therein and into contact with said first separation cylinders, wherein said material is agitated and transported and scrubbed across said separation surface, dislodging foreign matter within said material;

d) allowing said foreign matter to fall by gravity through said apertures in said surface;

e) propelling partially cleaned material from the furthermost downstream of said first separator cylinders through said outlet of said first housing, and directly into said second housing and into contact with said second separator cylinder;

f) transporting said partially cleaned fibers on said projections of said second separator cylinder, past said cleaning bars, thereby removing foreign matter therefrom;

g) removing cleaned fibers on said second separator cylinder with said first doffing means.

27. The process of claim 26 wherein said fiber containing material is selected from the group consisting of cotton, flax, and polyester.

* * * * *